US005662837A

United States Patent [19]

Saito et al.

[11] Patent Number: 5,662,837

[45] Date of Patent: Sep. 2, 1997

[54] METHOD AND APPARATUS FOR DISSOLVING AND ISOLATING CARBON DIOXIDE GAS UNDER THE SEA

[75] Inventors: Takayuki Saito; Takeo Kajishima, both of Tsukuba, Japan

[73] Assignee: Agency of Industrial Science and Technology, Tokyo, Japan

[21] Appl. No.: 534,802

[22] Filed: Sep. 27, 1995

[30] Foreign Application Priority Data

Oct. 6, 1994 [JP] Japan ..... 6-268309

[51] Int. Cl.[6] ..... B01F 3/04

[52] U.S. Cl. ..... 261/77; 261/93; 261/DIG. 7

[58] Field of Search ..... 261/77, 93, DIG. 7

[56] References Cited

U.S. PATENT DOCUMENTS

| | | | |
|---|---|---|---|
| 3,794,303 | 2/1974 | Hirshon | 261/77 |
| 3,865,908 | 2/1975 | Hirshon | 261/77 |
| 3,969,446 | 7/1976 | Franklin, Jr. | 261/77 |
| 4,107,240 | 8/1978 | Verner et al. | 261/77 |
| 4,235,607 | 11/1980 | Kinder et al. | 261/77 |
| 4,239,510 | 12/1980 | Hays et al. | 261/77 |
| 4,549,997 | 10/1985 | Verner et al. | 261/77 |
| 4,724,086 | 2/1988 | Kortmann | 261/77 |

*Primary Examiner*—Tim R. Miles

*Attorney, Agent, or Firm*—Oblon, Spivak, McClelland, Maier & Neustadt, P.C.

[57] ABSTRACT

The present invention provides a simple and efficient means for dissolving carbon dioxide gas discharged from sources such as thermoelectric power plants into the seawater and for isolating it at deep sea level. The means comprises an inverted U-shaped gas lift 1 having a shorter gas lift dissolving pipe 2 and a longer descending pipe 3 being connected with each other at the top, said gas lift dissolving pipe 2 is held at shallow sea level, and the lower end of the descending pipe 3 is opened at deep sea level. When carbon dioxide gas is injected in from the lower end of the gas lift dissolving pipe 2, the seawater is introduced from the lower end of the dissolving pipe by gas lift action of the carbon dioxide gas in the dissolving pipe 2, and the carbon dioxide is completely dissolved into the seawater until it reaches the upper end of the dissolving pipe. With its density increased due to dissolving of the carbon dioxide, the seawater is moved down by gravity to deep sea level through the descending pipe 3 and carbon dioxide is isolated at deep sea level.

5 Claims, 1 Drawing Sheet

METHOD AND APPARATUS FOR DISSOLVING AND ISOLATING CARBON DIOXIDE GAS UNDER THE SEA

BACKGROUND OF THE INVENTION

1. Field of the Invention

The present invention relates to a method and an apparatus for dissolving and isolating carbon dioxide gas, which is discharged in large quantity from stationary generating sources such as thermoelectric power plants, under the sea for preservation of global environmental conditions, and in particular to a method and an apparatus for dissolving and isolating carbon dioxide gas by dissolving the carbon dioxide gas into seawater at shallow sea level and by isolating it at deep sea level after it is sinked by gravity current.

2. Description of the Prior Art

In the past, for isolating carbon dioxide under the sea, the following methods have been adopted: (a) liquid carbon dioxide is directly discharged at deep sea level of 1000 m or deeper under the sea level; (b) carbon dioxide is isolated by directly dumping dry ice at deep sea level; or (c) carbon dioxide gas is discharged and dissolved in seawater at shallow level under the sea (200 to 400 m under sea level). In short, carbon dioxide gas has been discharged directly into the seawater in the past.

In the above methods (a) and (b), carbon dioxide can be isolated at deep sea level by avoiding the disposal in the water area with high biological density, while vast amount of energy is required for liquefying carbon dioxide, for transporting liquefied carbon dioxide, and for dumping liquefied carbon dioxide. For example, when total quantity of the carbon dioxide discharged from the sources such as thermoelectric power plants are disposed by the above methods (a) and (b), energy consumption will be by 40 to 50% higher than the energy currently consumed for this purpose.

On the other hand, by the method (c), it is possible to maintain the energy consumption to the level only by 10 to 20% higher than the current level. However, if renewing rate of the seawater at the blowing outlet of the carbon dioxide gas is low, dissolving efficiency is extremely low. Also, the problems such as acidification of the water area with high biological density and the secondary environmental problems caused by such acidification are unavoidable.

Further, all of the above methods (a), (b) and (c) are disadvantageous in that all of the pressure energy of the liquid carbon dioxide or carbon dioxide gas must be abandoned to the sea.

As described above, we must admit that all of the methods currently adopted have grave drawbacks in terms of energy and environmental problems.

SUMMARY OF THE INVENTION

It is a principal object of the present invention to provide a method and an apparatus, by which it is possible to dissolve carbon dioxide gas, discharged in large quantity from stationary generating sources such as thermoelectric power plants, in seawater and to isolate it at deep sea level in simple and efficient manner for preservation of global environmental conditions.

It is another object of the present invention to provide a simple and inexpensive means, by which it is possible to dissolve carbon dioxide gas at shallow level under the sea and to isolate it at deep sea level by gravity current utilizing density increase caused by the dissolving.

It is still another object of the present invention to provide a method and an apparatus for dissolving and isolating carbon dioxide gas in seawater, by which it is possible to increase renewing rate of the seawater to dissolve the carbon dioxide gas using an inverted U-shaped gas lift maintained under the sea and to improve dissolving efficiency.

It is still another object of the present invention to provide a means, by which it is possible to recover pressure energy of the carbon dioxide gas and to isolate the carbon dioxide gas at low cost.

To attain the above objects, a method for dissolving and isolating carbon dioxide gas according to the present invention comprises an inverted U-shaped gas lift having a shorter pipe and a longer pipe connected with each other at the top, thus forming an inverted U-shape, said shorter pipe being held at shallow sea level as a gas lift dissolving pipe, the carbon dioxide gas being injected into the pipe from a lower end thereof, seawater being introduced through the lower end of the dissolving pipe by gas lift action of the carbon dioxide gas in the dissolving pipe, the carbon dioxide being completely dissolved into the seawater until it reaches the upper end of the dissolving pipe, and using the longer pipe in the inverted U-shaped gas lift as a descending pipe with its lower end opened at deep sea level, the seawater with its density increased due to dissolving of the carbon dioxide is moved downward by gravity to the deep sea level.

The apparatus for dissolving and isolating carbon dioxide gas according to the present invention comprises an inverted U-shaped gas lift with a shorter pipe and a longer pipe connected with each other at the top, and using the shorter pipe of the inverted U-shaped gas lift as a gas lift dissolving pipe held at shallow sea level with a gas supplying inlet of a injecting unit of the carbon dioxide gas opened at its lower end, the lower end of the dissolving pipe being opened to introduce seawater by gas lift action of the carbon dioxide gas, and the longer pipe with its lower end opened at deep sea level being used as a descending pipe for sinking the seawater with its density increased due to the dissolving of the carbon dioxide within the gas lift dissolving pipe.

In the undersea dissolving and isolating apparatus for carbon dioxide gas as described above, diameter of the descending pipe is designed larger than that of the gas lift dissolving pipe, or impellers are installed on both or one of the gas lift dissolving pipe and the descending pipe, said impellers being rotated by movement of the seawater within these pipes, said impellers being connected to energy recovery units, said gas lift dissolving pipe being provided with counterflow preventing function, and a single or a plurality of control valves capable to control the flow movement within the pipe are installed in the gas lift dissolving pipe.

When carbon dioxide gas discharged in large quantity from stationary generating sources such as thermoelectric power plants are dissolved and isolated under the sea by the method and the apparatus with the above arrangement, the inverted U-shaped gas lift is installed under the sea, and a gas lift dissolving pipe of the inverted U-shaped gas lift is held at shallow sea level, and the lower end of the descending pipe is opened at deep sea level. Under this condition, carbon dioxide gas is injected into the gas lift dissolving pipe by a injecting unit with its feeding port at the lower end of the gas lift dissolving pipe. Then, the seawater introduced from the lower end of the gas lift dissolving pipe is moved upward by gas lift action together with the carbon dioxide gas through the dissolving pipe, and the carbon dioxide gas is completely dissolved into the seawater until it reaches the upper end of the dissolving pipe. Such means is effective to increase renewing rate of the seawater to dissolve the carbon dioxide and to improve dissolving efficiency.

With its density increased due to dissolving of the carbon dioxide, the seawater passes through a curved portion at the top of the inverted U-shaped gas lift and is sinked through the descending pipe with its lower end opened at deep sea level and is isolated at that level.

In the undersea dissolving and isolating process of carbon dioxide gas, when diameter of the descending pipe is designed larger than that of the gas lift dissolving pipe, pressure loss caused by the movement of the seawater is reduced and descending action by gravity can be promoted. If the impellers rotated by movement of the seawater in the pipes are installed and are connected with energy recovery units, it is possible to extensively reduce energy consumption by recovering pressure energy of the carbon dioxide through power generation. In particular, if the above impellers are installed on the gas lift dissolving pipe, carbon dioxide is micro-pulverized by rotation of the impellers, and dissolving can be improved.

Further, when control valves having counterflow preventing function and capable to control movement in the pipe are installed in the gas lift dissolving pipe, it is possible to keep balance of the movement of the seawater in the gas lift dissolving pipe and the descending pipe with respect to the injecting rate of the carbon dioxide gas into the gas lift dissolving pipe or to stabilize the movement when the operation is started. For driving the control valves, it is advantageous to utilize electric power obtained from the above energy recovery units.

As described above, carbon dioxide gas is dissolved into the seawater at shallow sea level, and carbon dioxide is isolated at deep sea level by gravity current utilizing the increase of density. Thus, it is possible to isolate carbon dioxide gas discharged in large quantity from generating sources such as thermoelectric power plants in simple and efficient manner, and this effectively contributes to the preservation of global environmental conditions.

DETAILED DESCRIPTION OF THE PREFERRED EMBODIMENT

Figure 1:
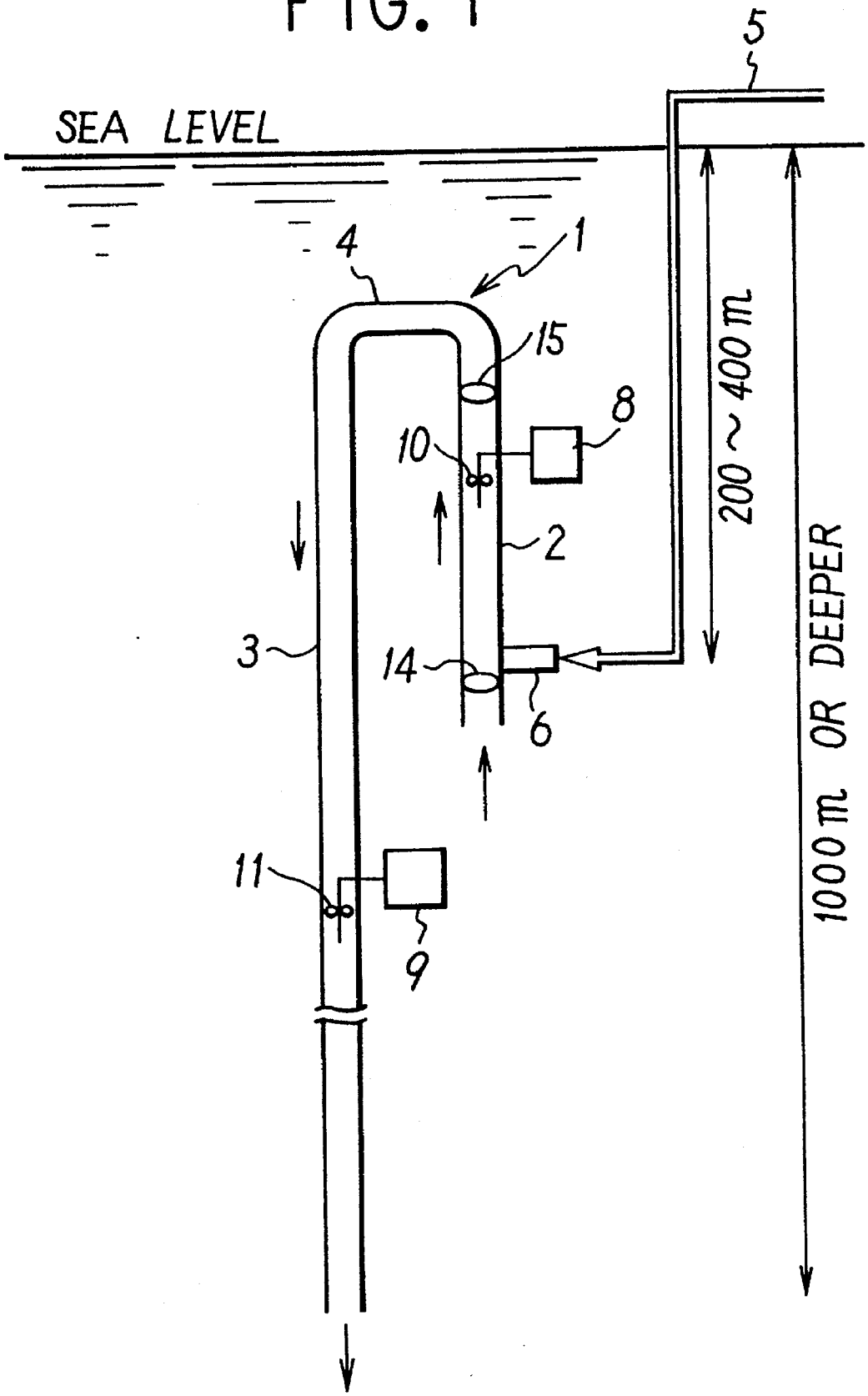
FIG. 1 is a schematical drawing of an apparatus for dissolving and isolating carbon dioxide gas according to the present invention.

The drawing represents an arrangement of an undersea apparatus for dissolving and isolating carbon dioxide gas according to the present invention.

The undersea apparatus for dissolving and isolating gas is used to dissolve carbon dioxide gas discharged in large quantity from stationary generating sources such as thermoelectric power plants and to isolate it at deep sea level. The apparatus comprises an inverted U-shaped gas lift 1, which has a shorter pipe and a longer pipe being connected with each other at the top. The inverted U-shaped gas lift 1 is placed in the sea, where a shorter gas lift dissolving pipe 2 is held at shallow level under the sea and the lower end of a longer descending pipe 3 is opened at deep sea level.

The gas lift dissolving pipe 2 of the inverted U-shaped gas lift has a blowing unit 6 at its lower end for blowing carbon dioxide gas supplied from a thermoelectric power plant, etc. through a feed pipe 5, and a gas inlet at the blowing unit is opened to the lower end of the gas lift dissolving pipe, and the lower end of the dissolving pipe 2 is opened to introduce seawater by gas lift action of the carbon dioxide gas thus blown in.

The carbon dioxide gas is blown into the inverted U-shaped gas lift 1 by the pressure corresponding to the depth where the gas is blown to and the pressure, which matches pressure loss generated in the process to carry the carbon dioxide gas from a stationary generating source to the position of the undersea dissolving and isolating apparatus.

On the other hand, the descending pipe 3 connected to the gas lift dissolving pipe 2 via a curved pipe 4 at the top is used to move down the seawater by gravity, which has its density increased due to dissolving of carbon dioxide in the gas lift dissolving pipe 2, and the lower end of the descending pipe is opened at deep sea level.

When the inverted U-shaped gas lift 1 is placed under the sea, the gas lift dissolving pipe 2 is perferably has a pipe length of 100 to 200 m and has its lower end at the depth of 200 to 400 m, and the descending pipe 3 has preferably a pipe length of about 1000 to 2000 m.

The descending pipe 3 is designed with a diameter larger than that of the gas lift dissolving pipe 2, and this makes it possible to reduce pressure loss due to movement of the seawater and to promote the descending action by gravity.

The gas lift dissolving pipe 2 and the descending pipe 3 are equipped with impellers, which are rotated by movement of the seawater in these pipes, and these are connected with energy recovery units 8 and 9 respectively. These impellers and the energy recovery units are used to recover pressure energy of carbon dioxide by power generation and to extensively reduce energy consumption. The impeller 10 mounted in the gas lift dissolving pipe 2 is effective micro-pulverize carbon dioxide blown in by the rotation of the impeller and to promote the dissolving.

The impellers and the energy recovery units may be arranged only on one of the gas lift dissolving pipe 2 or the descending pipe 3.

Further, in the gas lift dissolving pipe 2, control valves 14 and 15 having counterflow preventing function and capable to control the flow in the pipe are provided at suction inlet of the seawater at the lower end of the gas lift dissolving pipe 2 and in upper portion of the pipe 2 respectively. These control valves 14 and 15 are used to keep balance between the seawater movement in the gas lift dissolving pipe 2 and the descending pipe 3 with respect to the quantity of carbon dioxide gas injected into the gas lift dissolving pipe 2 or to stabilize seawater movement when the operation is started. In case the control valves 14 and 15 are driven to control the flowing in the gas lift dissolving pipe 2 and the descending pipe 3, it is advantageous to utilize electric power, which has been obtained by the energy recovery units 8 and 9.

When carbon dioxide gas discharged from a thermoelectric power plant is dissolved and isolated under the sea by the apparatus with the above arrangement, the inverted U-shaped gas lift 1 is installed under the sea and the gas lift dissolving pipe 2 in the inverted U-shaped gas lift 1 is maintained at shallow level under the sea, while the lower end of the descending pipe 3 is opened at deep sea level. Under this condition, carbon dioxide gas is injected into the gas lift dissolving pipe 2 by the injecting unit 6 with its injecting outlet opened at the lower end of the gas lift dissolving pipe 2. As the gas is injected, the seawater sucked from the lower end of the gas lift dissolving pipe 2 is moved upward through the dissolving pipe 2 together with the carbon dioxide gas by gas lift action, and the carbon dioxide gas is completely dissolved into the seawater until it reaches the upper end of the dissolving pipe 2. When the carbon dioxide gas is dissolved into the seawater in this way, there is always fresh seawater around, and the dissolving efficiency is higher than the case where large quantity of carbon dioxide gas is dissolved into the same stagnated seawater.

With its density increased due to dissolving of carbon dioxide, the seawater passes through the curved pipe 4 at the top of the inverted U-shaped gas lift 1 and is moved down by gravity through the descending pipe 3 with its lower end opened at deep sea level and is isolated at deep sea level.

In this way, when the carbon dioxide gas is dissolve into the seawater at shallow level under the sea and carbon dioxide gas is moved down to the deep sea level by gravity because of the increase of the density, it is possible to isolate the carbon dioxide gas discharged in large quantity from thermoelectric power plant at deep sea level in simple and efficient manner, and this will contribute to the preservation of global environmental conditions.

Next, description is given on an experimental example and a numerical simulation example of the present invention. In this experiment, a water tank of 14 m in depth was used and an inverted U-shaped gas lift of 50 mm in diameter 12.6 m in pipe length was used. This pipe was designed smaller size than but has essentially the same structure as the one shown in FIG. 1. The flow rate of the injected gas was set to about 0.4 Nm3/min. (=800 g). The renewing rate of the seawater by the inverted U-shaped gas lift was about 0.18 m3/min. at maximum.

Using the pressure loss and bubble ascending speed obtained in this experiment, the values at the depth of 200 m were calculated. As a result, with the pipe diameter of 150 mm and the dissolving pipe length of 100 m, the seawater renewing rate was about 1 m3/min., and carbon dioxide dissolving quantity was about 10 kg/min. The increase rate of seawater density in this case was about 1.6 kg/min., and sufficient descending flow was provided within the inverted U-shaped descending pipe.

Also, kinetic energy given to the seawater from bubbles of carbon dioxide is about 0.5 J per unit mass flow rate. If it is supposed that 10% of this is recovered through the impellers, the energy sufficient for operating the control valves can be obtained.

What we claim are:

1. A method for dissolving and isolating carbon dioxide gas under the sea, comprising:

an inverted U-shaped gas lift having a shorter pipe and a longer pipe being connected with each other at the top, said shorter pipe is held at shallow sea level as a gas lift dissolving pipe, carbon dioxide gas is injected into the pipe through the lower end thereof, seawater is introduced from the lower end of the dissolving pipe by gas lift action of the carbon dioxide gas in the pipe, said carbon dioxide gas is completely dissolved into the seawater until it reaches the upper end of the dissolving pipe; and said longer pipe of the inverted U-shaped gas lift is used as a descending pipe with its lower end opened at deep sea level, and the seawater with density increased due to dissolving of the carbon dioxide is moved to deep sea level by gravity.

2. An apparatus for dissolving and isolating carbon dioxide gas under the sea, comprising:

an inverted U-shaped gas lift having a shorter pipe and a longer pipe connected with each other at the top;

said shorter pipe of the inverted U-shaped gas lift is used as a gas lift dissolving pipe held at shallow sea level, a gas supply inlet at a blowing unit for carbon dioxide gas is opened at lower end thereof, and the lower end of the dissolving pipe is opened for introducing seawater by gas lift action of the carbon dioxide gas; and said longer pipe with its lower end opened at deep sea level is used as a descending pipe for moving down the seawater with its density increased due to dissolving of carbon dioxide in the gas lift dissolving pipe by gravity.

3. An apparatus for dissolving and isolating carbon dioxide gas under the sea according to claim 2, wherein:

diameter of the descending pipe is designed larger than that of the gas lift dissolving pipe.

4. An apparatus for dissolving and isolating carbon dioxide gas according to one of claims 2 or 3, wherein:

impellers rotated by movement of seawater in the pipes are installed in both or one of the gas lift dissolving pipe and the descending pipe and said impellers are connected with energy recovery units.

5. An apparatus for dissolving and isolating carbon dioxide gas under the sea according to one of claims 2 or 3, wherein:

control valves having counterflow preventing function and capable to control flowing movement in the pipe are installed in the gas lift dissolving pipe.

* * * * *